United States Patent [19]

Stern

[11] Patent Number: 4,827,955

[45] Date of Patent: May 9, 1989

[54] DEVICE FOR CLEANING PAINT DISTRIBUTING CHANNELS IN SPRAY GUNS

[76] Inventor: Leif E. Stern, Fattershus, S-225 90 Lund, Sweden

[21] Appl. No.: 3,396

[22] Filed: Jan. 14, 1987

[30] Foreign Application Priority Data

Jan. 20, 1986 [SE] Sweden ..... 8600219

[51] Int. Cl.[4] ..... B08B 9/00; B08B 3/02

[52] U.S. Cl. ..... 134/99; 134/109; 134/111; 134/169 R; 134/170

[58] Field of Search ..... 134/170, 166 R, 168 R, 134/169 R, 99, 104, 109, 102, 111; 15/302, 310, 409; 239/106, 120, 121

[56] References Cited

U.S. PATENT DOCUMENTS

| | | | |
|---|---|---|---|
| 2,682,273 | 6/1954 | Roach | 134/170 |
| 2,745,418 | 5/1956 | Balcom et al. | 134/166 R |
| 3,227,167 | 1/1966 | Parent | 134/109 |
| 3,771,539 | 11/1973 | DeSantis | 134/170 |
| 4,055,870 | 11/1977 | Furutsutsumi | 15/409 |
| 4,362,572 | 12/1982 | Wallace | 239/106 |
| 4,561,903 | 12/1985 | Blaul | 134/104 |

FOREIGN PATENT DOCUMENTS 2249884 9/1973 Fed. Rep. of Germany .

*Primary Examiner*—Harvey C. Hornsby
*Assistant Examiner*—S. Gerrity
*Attorney, Agent, or Firm*—Foley & Lardner, Schwartz, Jeffery, Schwaab, Mack, Blumenthal & Evans

[57] ABSTRACT

The present invention relates to a device for cleaning paint distributing channels in spray guns, whereby paint distributing channels are adapted to direct paint from a supply (3) thereof to a paint discharge nozzle (5) and cleanable by leading a dissolvent (6) filled into the paint supply (3) from the supply through the paint distributing channels (2) and out from the spray gun (1) through its paint discharge nozzle (5). In order to prevent the dissolvent (6) flowing through the paint distributing passages from escaping into the surroundings, the device comprises a suction system (7) in which a vacuum is generated and which includes a connecting unit (8) to which the paint discharge nozzle (5) of the spray gun (1) may be connected or which may be connected to the paint discharge nozzle (5) in order to, by means of the vacuum in the suction system (7) suck dissolvent (6) from the paint supply (3) through the paint distributing channels (2) and the paint discharge nozzle (5), whereby one or more collecting containers (9) are provided to collect dissolvent (6) suck from the spray gun (1).

9 Claims, 7 Drawing Sheets

DEVICE FOR CLEANING PAINT DISTRIBUTING CHANNELS IN SPRAY GUNS

BACKGROUND OF THE INVENTION

1. Field of the invention

The present invention relates to a device for cleaning paint distributing channels in spray guns, whereby said paint distributing channels are adapted to direct paint from a supply thereof to a paint discharge nozzle and cleanable by leading a dissolvent filled into said paint supply from the supply through said paint distributing channels and out from the spray gun through its paint discharge nozzle.

2. Related Art

Compressed-air-operated spray guns of the aforementioned type are commonly cleaned by removing eventual paint residuals from the paint supply and pouring paint dissolvents therein. Thereafter, the trigger is pulled, which means that the compressed air will move the dissolvent through the paint distributing channels wherein adhering paint residuals will be dissolved and removed through the paint discharge nozzle. This cleaning procedure is efficient per se but because of today demands for a clean environment quite unacceptable, since the dissolvent mingled with paint residuals is sprayed directly into the air, contaminating the same.

OBJECTS AND SUMMARY OF THE INVENTION

The object of the present invention is to eliminate this problem and, in a device of the abovementioned type, see to it that the paint distributing channels in the spray gun are effectively cleaned without spraying dissolvent into the air. For this object, the device has a suction system in which a vacuum is generated a suction system in which a vacuum is generated and which includes a connecting unit to which the paint discharge nozzle of the spray gun may be connected or which may be connected to the paint discharge nozzle in order to, by means of the vacuum in the suction system, suck dissolvent from the paint supply through the paint distributing channels and the paint discharge nozzle, whereby one or more collecting contains are provided to collect dissolvent sucked from the spray gun.

By this means dissolvent is brought to flow through the paint distributing channels by being sucked therethrough to a collecting container, which means that the dissolvent does not escape into the air as was previously the case.

BRIEF DESCRIPTION OF THE DRAWINGS

The invention will be further described below with reference to the accompanying drawings, in which.

DETAILED DESCRIPTION OF THE INVENTION

Figure 1:
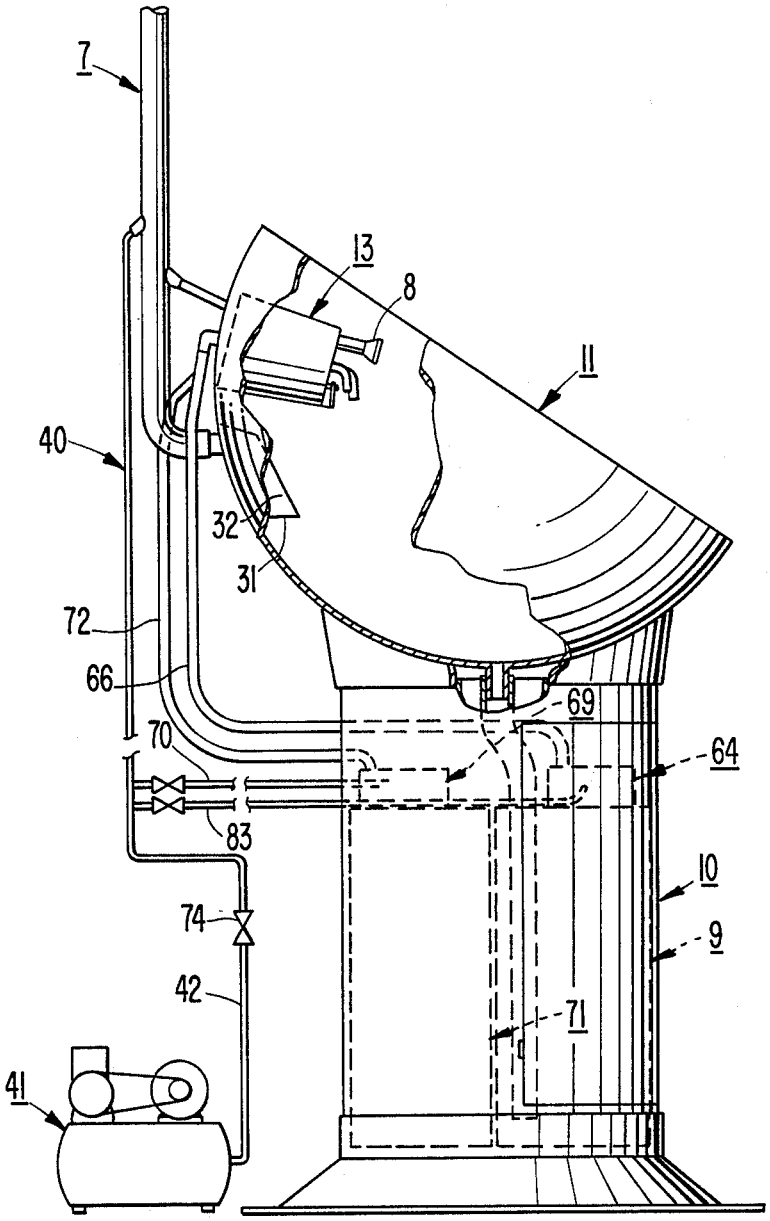
FIG. 1 is a side view of the device according to the invention.

The device illustrated in the drawings is adapted for cleaning paint distributing channels 2 in spray guns 1, i.e. channels 2 adapted to direct paint from a paint supply 3 in a paint container 4 connectable to the spray gun 1 to a paint discharge gun 5. The paint distributing channels 2 are cleaned by removing paint therefrom after use of the spray gun or when one observes that there is dry paint therein. Cleaning occurs by emptying the paint container 4 of remaining paint and pouring a suitable paint dissolvent therein. The paint container is thereafter reconnected to the spray gun 1 and the dissolvent 6 is brought to flow through the paint distributing channels 2 dissolving paint from their walls and carry this and other paint away through the paint discharge nozzle. For this purpose and for collecting the dissolvent 6 after its cleaning of the paint distributing channels 2, the device illustrated in the drawings comprises a suction system 7, in which a vacuum is generated and which includes a connecting unit 8, to which the paint discharge nozzle 5 of the spray gun 1 may be connected or which may be connected to said paint discharge nozzle 5 in order to, by means of the vacuum in the suction system 7, suck dissolvent 6 from the paint supply 3 through the paint distributing channels 2 and the paint discharge nozzle 5, whereby one or more collecting containers 9 are provided to collect dissolvent 6 suck from the spray gun 1.

Figure 2:
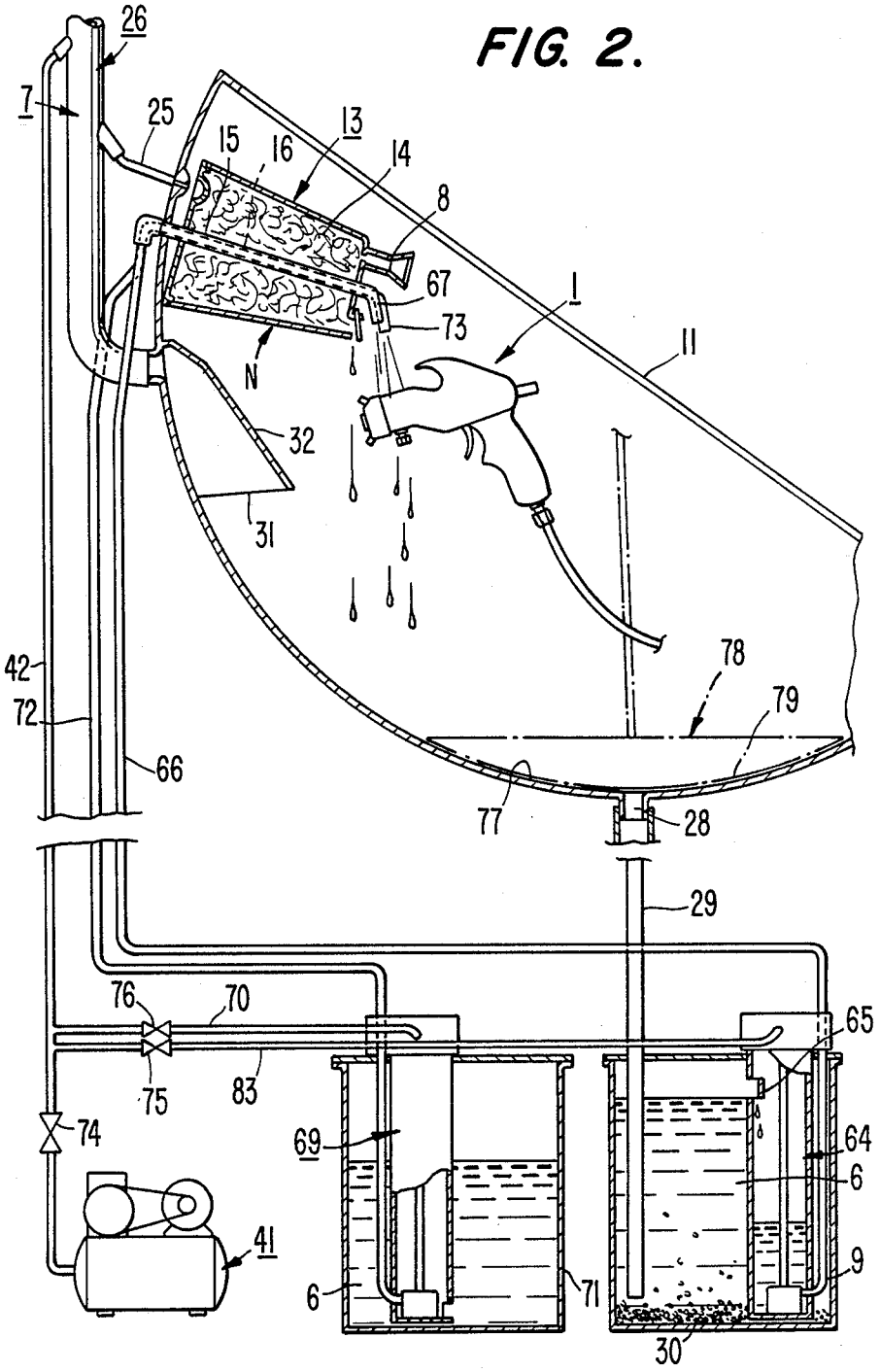
FIG. 2 is a side view, partially in section, of parts of the device according to FIG. 1.

The device providing the suction effect comprises, in more detail, a frame 10 with a washing bowl 11 which at least on the inner side has the shape of an upwardly open semisphere. In the upper part of the washing bowl 11 there is provided a separating device 12 for separating dissolvent 6 sucked out from the spray gun 1 from the air in the suction system 7 and collect this separated dissolvent 6, whereby the dissolvent is prevented from being sucked further into the suction system 7. The separating device 12 includes in this case a collecting vessel 13 which is preferably filled with a suitable filter material 14 for separating the dissolvent from an incoming air/dissolvent-mixture such that the dissolvent is collected in the collecting vessel while the air may pass further into the suction system 7. The collecting vessel 13 is suspended somewhat moveable on two beside each other; positioned tubes 15, 16 passing through the wall of the washing bowl 11 in such a manner that it in a normal position N due to its weight engages the washing bowl 11 with a lower corner. The collecting vessel 13 includes, at an upper front portion, the connecting unit 8 adapted for connection of the paint discharge nozzle 5 of the spray gun 1 and includes, at a lower front portion, a drain valve 17 consisting of an opening 18 and a valve body 20 movably provided on a screw 19 and adapted to close or open said opening 18. The collecting vessel 13 further comprises at an upper rear portion a coupling portion 21 having an opening 22. The washing bowl 11 includes a coupling portion 23 with an opening 24, which through a conduit 25 communicates with a vacuum generating device 34, forming part of the suction system 7, in a ventilating passage 26 formed by e.g. a tube 27. The coupling portion 21 of the collecting vessel 13 does not connect to the coupling portion 23 of the washing bowl 11 when the collecting vessel 13 is in its normal position N (FIG. 2), but said collecting vessel 13 is movably provided on the tubes 15, 16 such that it may tilted backwards until the coupling portion 21 thereof connects to the coupling portion 23 of the washing bowl 11 and the opening 22 communicates with the opening 24. This tilting backwards of the collecting vessel 13 is obtained by engaging said vessel by the paint discharge nozzle 5 of the spray gun 1 and thereafter tilting the vessel backwards by means of the spray gun 1.

Figure 3:
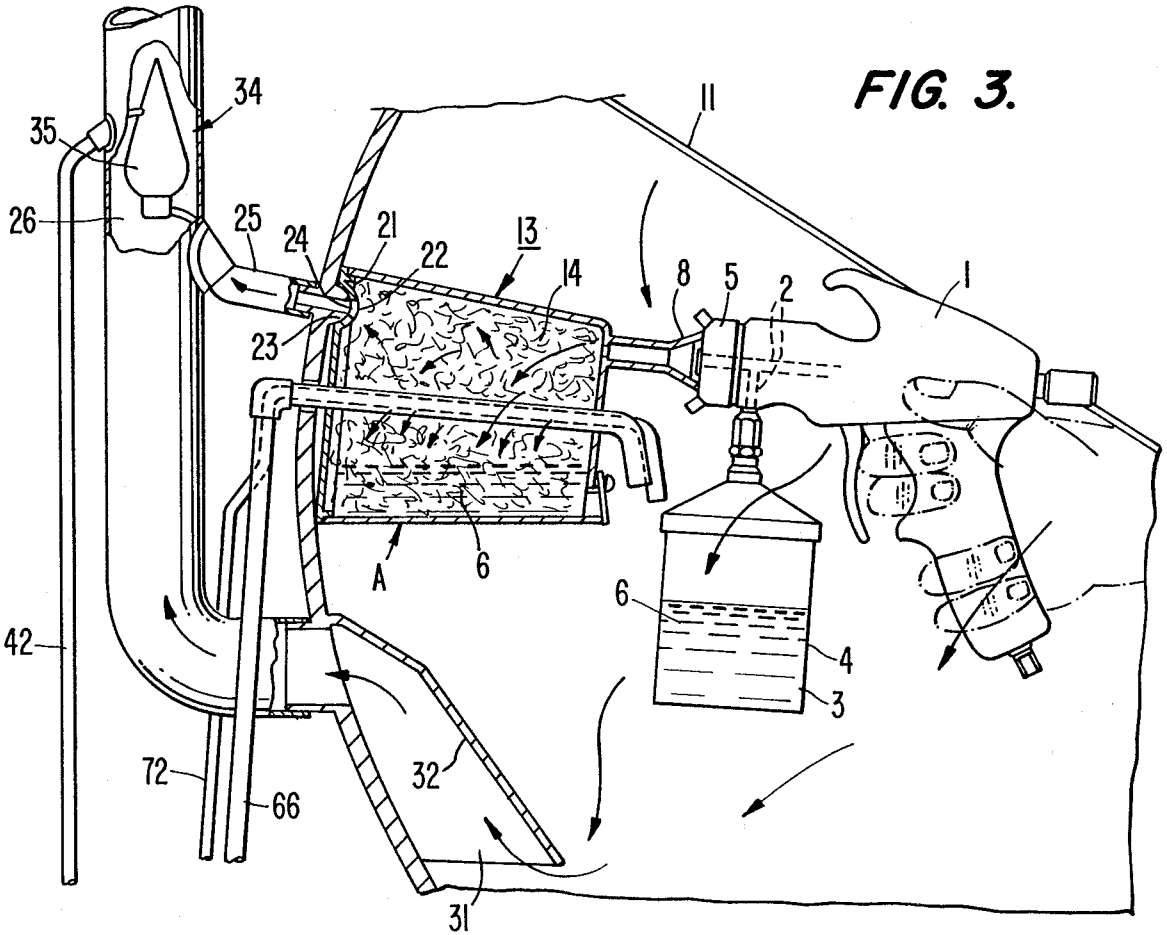
FIG. 3 is a side view, partially in section, of parts of the device during a suction moment.

The separating device 12 operates in such a manner that the spray gun 1 is connected to the connecting unit 8 and the collecting vessel 13 is tilted backwards by pressing it backwards by means of the spray gun 1. Thereby, the collecting vessel 13 is set in a position A (see FIG. 3), wherein the interior of the collecting vessel 13 connects to the conduit 25 and the vacuum generating device 34 in the ventilating passage 26, which means that a vacuum will be present in the collecting vessel 13 and in the paint distributing passages 2 in the spray gun 1 connected to the connecting unit 8. Since a vacuum is present in said spaces, dissolvent 6 will be sucked from the paint container through the paint distributing passages 2, paint discharge nozzle 5 and connecting unit 8 into the collecting vessel 13. The filter material 14 therein will provide for separation of the dissolvent 6 from the incoming air/dissolvent-mixture and the separated dissolvent 6 will be collected in the collecting vessel 13 during the washing or cleaning moment, since the vacuum in the collecting vessel 13 allows for the valve body 20 to keep the opening 18 closed (see FIG. 3). After this separation, the substantially dissolvent-free air will be sucked further into the conduit 25.

Figure 4:
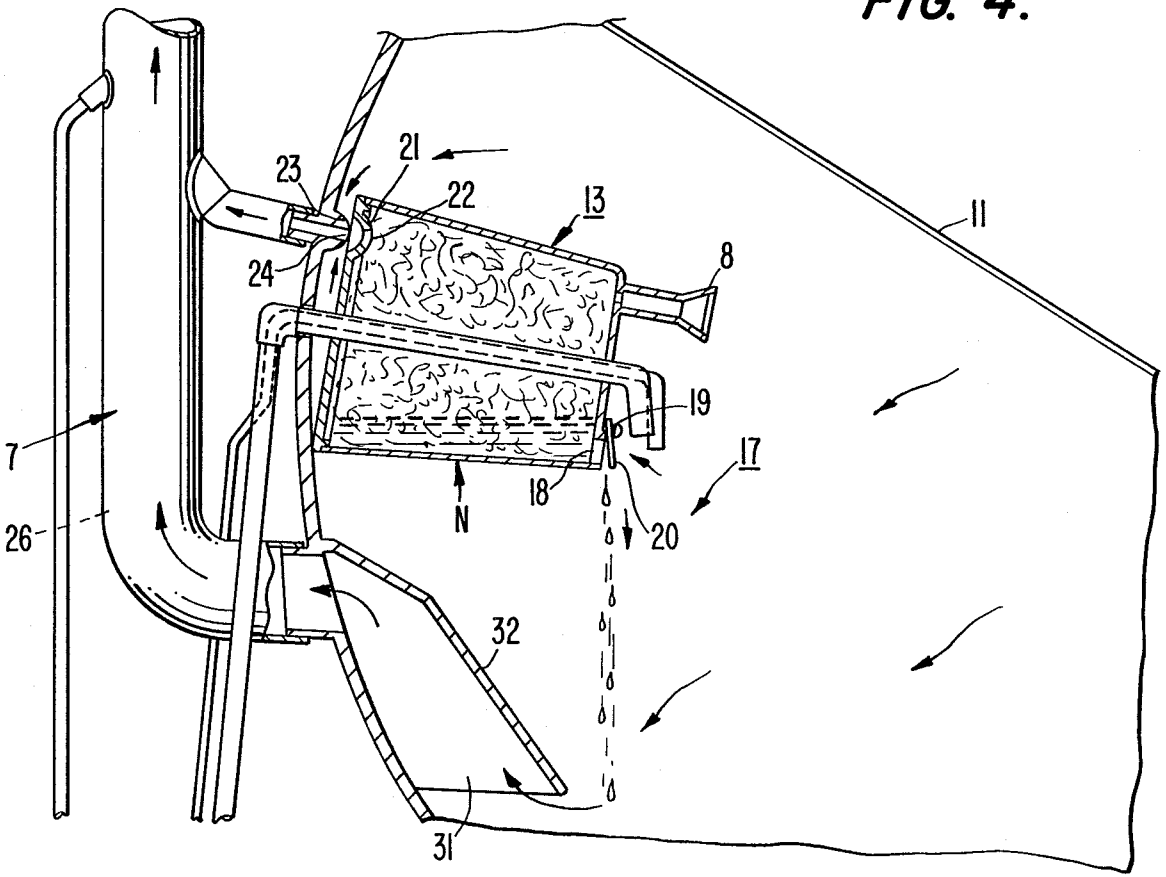
FIG. 4 illustrates the same parts as in FIG. 3 after the suction moment.

When the washing or cleaning procedure is finished, the spray gun is removed, whereby the collecting vessel 13 returns from its connecting position A to its normal position N, which means that the connection between the interior of the collecting vessel 13 and the vacuum generating device 34 is cut. Hereby, the vacuum in the collecting vessel will cease and the dissolvent therein may disappear through the opening 18 by pushing away the valve body 20 (see FIG. 4). The dissolvent 6 will flow down into the washing bowl 11 and through a hole 28 in the bottom and a conduit 29 connecting thereto into the lower parts of the collecting container 9, wherein contaminants 30 in the dissolvent 6 will be collected.

The suction system 7 further includes an air inlet 31, wherein a vacuum is generated while said inlet communicates with the ventilating passage 26, said vacuum being generated by a suction hood 32 provided in the washing bowl 11 such that the air inlet is capable of sucking dissolvent vapours 33 generated in the washing bowl 11 when dissolvent 6 sucked out from the spray gun 1 flows down into the washing bowl 11 or when the spray gun 1 and/or other tools (not shown) are washed, preferably exteriorly, with dissolvent 6 in the washing bowl 11.

The device 34 generating vacuum in the ventilating passage 26 and the conduit 25 preferably comprises an ejector device 35 generating the vacuum by generating powerful air streams in the ventilating passage 26 and the conduit 25. The ejector device 35 includes an air guide unit 36 which is centered in the ventilating passage 26 by means of three rods 37, 38 and 39. Of these rods, rod 37 is tubular and adapted to form part of a compressed-air supply device 40 designed to direct compressed air from a compressed-air aggregate, preferably a compressor 41 and a conduit 42 connected thereto, to the tubular rod 37 and thereafter through a compressed-air distributing passage 43 in the air guide unit 36 to a nozzle 44 for discharging drive or operating air streams 45, 46 at a high velocity. The compressor 41 can generate an air pressure of 5–7 bars or another suitable pressure in the compressed-air supply device 40. The nozzle 44 includes a narrow, annular air guide slit 47 provided by a slit defining means 48 and a center member 49 of the air guide unit 36 within said means. The slit defining means 48 has a tubular attachment means 50 which is inserted into the compressed-air distributing passage 43 for securing said means 48 to the air guide unit 36.

The air guide unit 36 includes a front portion 52 expanding successively in the flowing direction 51 of the ventilating passage 26 and a rear portion 53 tapering successively in the flowing direction of the ventilating passage in order to define, together with a surrounding inner surface 54 of the ventilating passage 26, an annular air through-flow slit 55, 56, 57 having first a successively decreasing and thereafter a successively increasing cross-sectional area, whereby the nozzle 44 is provided to bring the drive air streams 45, 46 to flow along an arcuate air guide surface 58 of the front portion 52 in an outwards direction towards the narrowest parts 57 of the air through-flow slit 55, 56, 57, whereby the drive air streams 45, 46 successively mix with air 59 in the ventilating passage upstream of the air guide unit 36. In more detail, the front portion 52 of the air guide unit 36 is substantially formed as a semisphere and the rear portion 53 substantially as a cone. This semispheric front portion 52 transforms into the conical rear portion 53 through an even transition.

This structural embodiment results in that the powerful drive or operating air streams 45, 46 will flow out of the nozzle 44 in all directions along the centre member 49 and through an even transition between said member and the surrounding air guide surface 58 to this surface. The drive air streams 45, 46 will thereafter follow the arcuate shape of the air guide surface 58 and thereby be guided to flow towards the narrowest parts 57 of the air through-flow slit. Hereby, the drive air streams 45, 46 will successively and without substantial turbulence mix with the air 59 in that part of the air through-flow slit having successively decreasing cross-sectional area. This means that the drive air streams 45, 46 will influence the air 59 to flow towards the narrowest parts 57 of the air through-flow slit with a successive velocity increase until the air mixture has reached these parts. After the air mixture has passed through the narrowest parts 57 of the air through-flow slit and into the parts 56 with successively increasing through-flow area, the velocity of the air mixture will decrease and the air streams will "leave" the rear portion 53 of the air guide unit 36 successively and without substantial turbulence because of the successive taper of said rear portion 53. While this device permits substantially turbulence-free air flow, a surprisingly great air velocity is reached in the ventilating passage 26 relative to the amount and velocity of the compressed air supplied. Furthermore, the device operates at a substantially lower sound level than prior art devices with the same effect.

The abovementioned ejector device 35 generating an air flow in the ventilating passage 26, also generates a vacuum in the conduit 25. This conduit is connected to a suction nozzle 60 which is thread onto a protruding part 61 of the nozzle 44 and has an annular slit-defining surface 62 providing with the centre members 49 of the air guide unit 36 an annular slit 63 around the nozzle 44 discharging the drive air streams 45, 46. Hereby, the drive air streams 45, 46 also generate an air flow in the interior of the suction nozzle 60. The suction nozzle 60 is preferably releasably mounted on the protruding part 61 of the nozzle 44. This is advantageous while the annular, slit-defining surface 62 of the suction nozzle 60 is easier to rinse from deposits after removing the nozzle 60 and turning it outwards.

Figure 5:
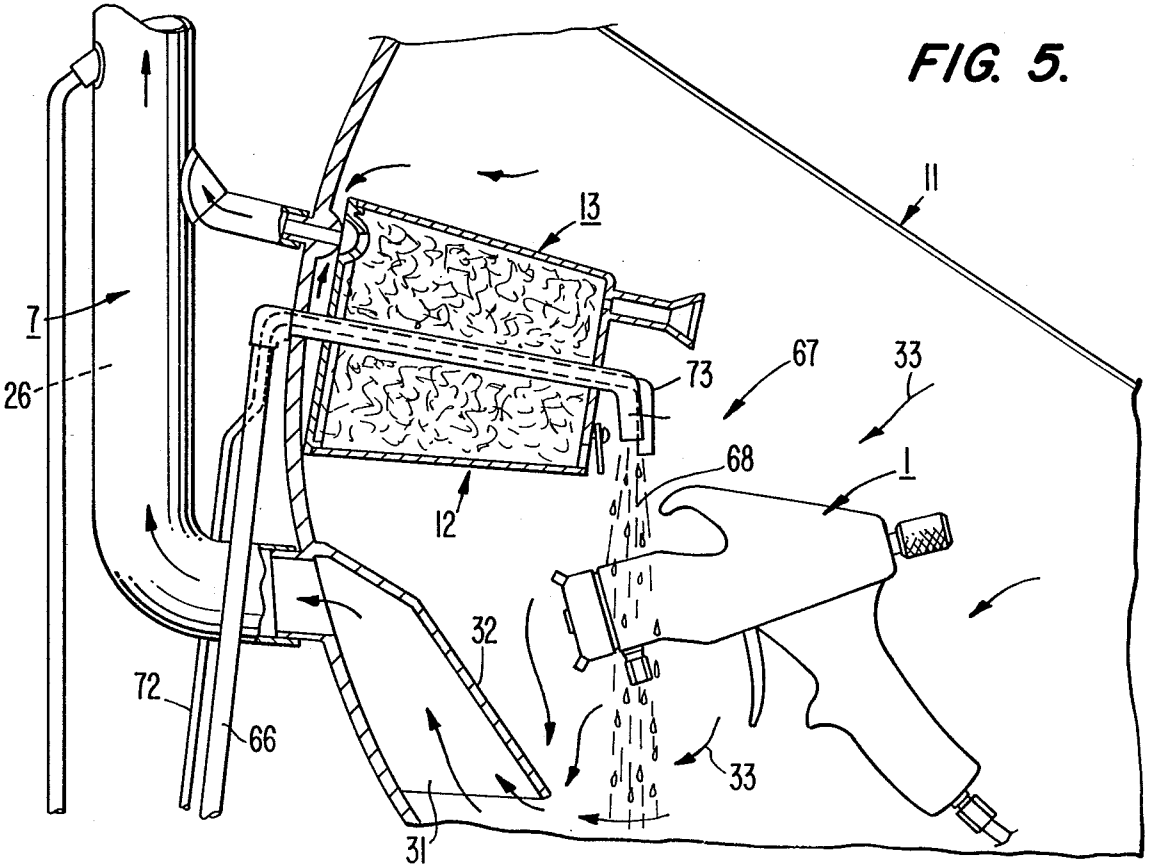
FIG. 5 illustrates the same parts as in FIGS. 3 and 4 during a washing moment.
Figure 6:
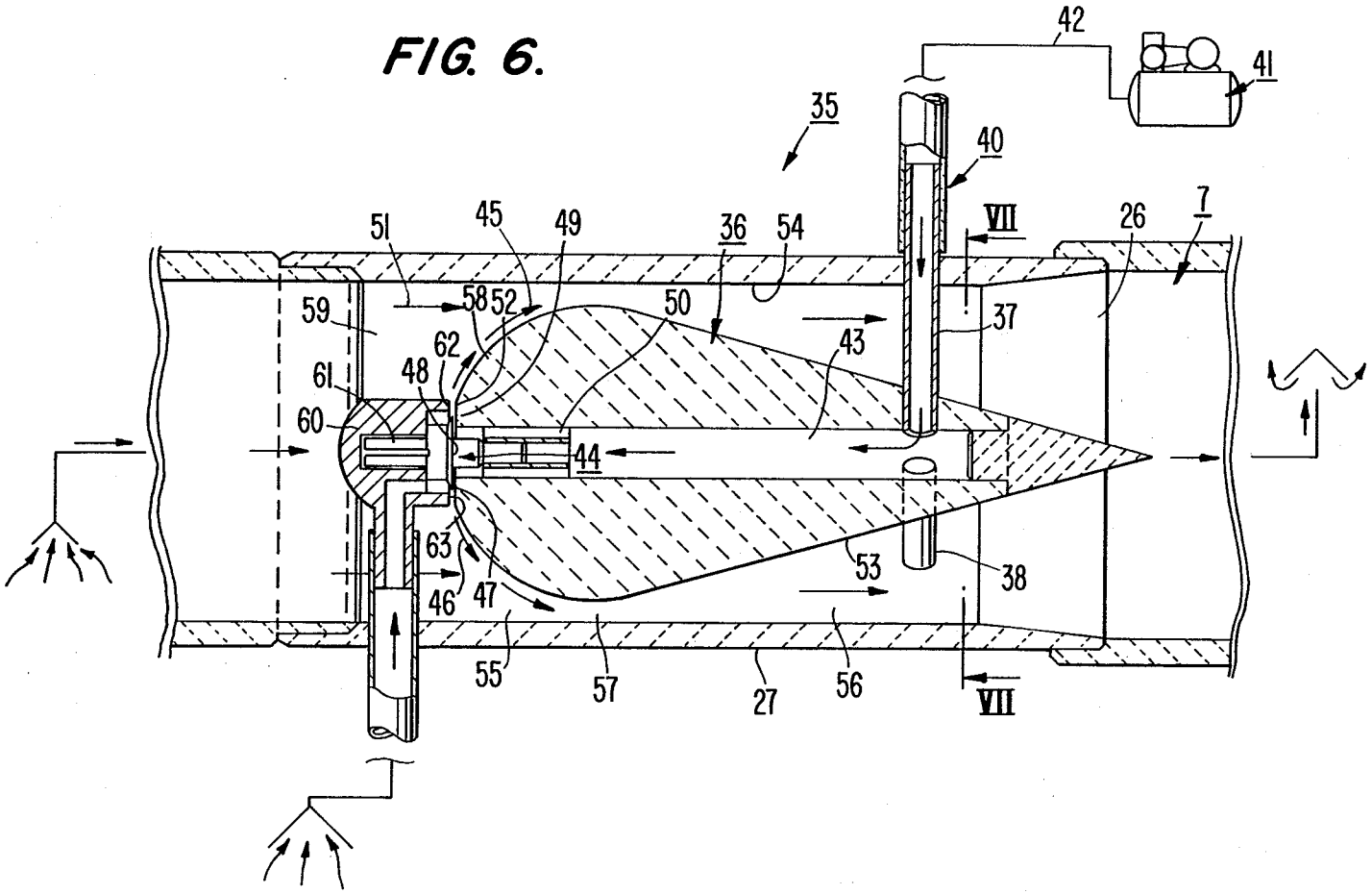
FIG. 6 is a section through an ejector forming part of the device according to the preceding figures.
Figure 7:
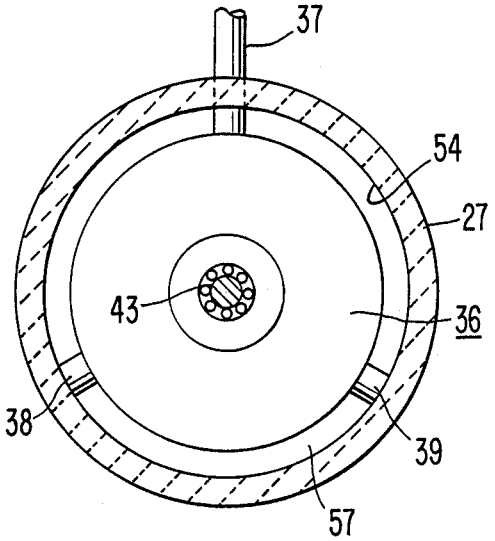
FIG. 7 is a section along the line VII—VII in FIG. 6.

The compressed-air aggregate, i.e. here the compressor 41, also operates through a conduit 83 a compressed-air operated pump 64, which is lowered into the collecting container 9. This pump 64 has an upper inlet 65 for receiving dissolvent 6 from the collecting container 9 not containing any contaminants 30. From the pump 64, a conduit 66 extends upward and into the washing bowl 11 and this conduit has a washing nozzle 67 provided in said washing bowl 11. The pump 64 is adapted to pump, through the conduit 66, relatively clean dissolvent 6 from the collecting container 9 to the washing nozzle 67, which is designed to discharge jets 68 of dissolvent into the washing bowl 11 such that the spray gun 1 or other tools or objects contaminated with paint may be washed exteriorly (see FIG. 5).

The compressor 41 also operates a compressed-air operated pump 69 through a conduit 70 and this pump is immersed into a container 71 containing clean dissolvent 6 and adapted to pump dissolvent 6 from this container 71 through a conduit 72 to a washing nozzle 73 in the washing bowl 11. Hereby, the spray gun 1 or other tools may be washed on the outside with clean dissolvent.

In the conduit 42 of the compressed-air supply device 40 there is provided a start and stop device 74, preferably a valve opening or closing. said conduit 42. This device 74 is positioned between the compressor 41 and those parts of the conduit 42 from which the conduits 83 and 70 to the pumps 64 and 69 branch off. The start and stop device 74 is adapted to start and stop the suction effect in the suction system 7 and by positioning said device 74 on the conduit 42, it is ensured that operation of the pumps 64, 69 occurs only when the suction system 7 is operating, i.e. the washing bowl 11 is ventilated by means of the air inlet 31.

As is apparent from the drawings, the conduit 83 has a valve 75 for opening and closing said conduit 83 and the conduit 70 has a valve 76 for opening and closing this conduit 70. Additionally, the upper parts of the conduits 66, 72 are used to provide those tubes 15, 16 on which the collecting vessel 13 is suspended.

While the washing bowl 11 has the shape of a semisphere, the lower spheric parts 77 thereof are easy to clean by means of a cleaning tool 78 in the form of a cleaning spade with a cleaning edge 79 corresponding to said spheric shape.

Cleaning by means of said spade 78 occurs by moving the spade down into the washing bowl 11 until the cleaning edge 79 thereof engages the washing bowl, whereafter the spade 78 is rotated.

The invention is not limited to the embodiment illustrated in the drawings, but may vary within the scope of the subsequent claims. The object of the invention is to suck dissolvent through the paint distributing passages of the spray gun and this object may be attained by different means, of which those described above have worked very well. Finally, it may be noticed that as dissolvent any liquid paint dissolving agent may be utilized; the connecting unit may be connectable to the spray gun instead of the spray gun to said unit; the separating device may be of another type; the filter therein may be replaced by other means for separating liquid and air; dissolvent collected in the separating device may be directed to the collecting container an another way than by flowing freely into the washing bowl and therefrom to the collecting container; the ejector device may be another vacuum generating device; the washing devices for washing the spray gun exteriorly may be dispensed with; various means, e.g. containers, pumps, washing nozzles, etc. may vary in type and number.

I claim:

1. A device for cleaning paint distributing channels in spray guns having a paint/dissolvent supply container connected through distributing channels to a paint discharge nozzle on the spray gun comprising:

(a) a suction means for generating a vacuum;

(b) means for connecting said suction means to the nozzle;

(c) means for collecting paint/dissolvent from the supply container and said connecting means;

(d) said suction means comprising a ventilating passage, and an ejector device mounted in said ventilating passage;

(e) said ejector device comprising an ejector nozzle means for discharging air streams at a high velocity; and (f) a suction nozzle cooperating with said ejector nozzle forming means for discharging drive air streams in order to, by means of the drive air streams, generate a vacuum in said connecting means.

2. Device according to claim 1, wherein the suction means comprises an air inlet provided to suck dissolvent vapours generated in a washing bowl when dissolvent sucked from the spray gun flows down into said bowl or when the spray gun and/or other tools are washed exteriorly with dissolvent in the washing bowl.

3. Device according to claim 2, wherein the air streams are generated by means of a compressed-air streams are generated compressed air generated by said compressed-air aggregate is also used for operating, at least one pump which is adapted to pump dissolvent from the collecting container to at least one washing nozzle for washing the spray gun and/or other tools in the washing bowl.

4. Device according to claim 3, wherein the compressed air generated by the compressed-air aggregate is used for operating a first pump for pumping dissolvent to the washing nozzle from a collecting container, wherein dissolvent coming from the washing bowl is collected, whereby said first pump is adapted to receive dissolvent from upper parts of the collecting container and whereby compressed air generated by the compressed-air aggregate is used for operating a second pump for pumping dissolvent from a container containing clean dissolvent to a washing nozzle in the washing bowl.

5. Device according to claim 3, wherein a start and stop device is mounted in a compressed-air system connected to the compressed-air aggregate such that operation of the pump is possible only when the suction means is operating.

6. Device according to claim 3, wherein said ejector device also comprises an air guide unit positioned in the ventilating passage and having a front portion expanding successively in the flowing direction of the ventilating passage and a rear portion tapering successively in the flowing direction of the ventilating passage in order to define, together with a surrounding inner surface of the ventilating passage an annular air through flow slit having first a successively decreasing and therafter a successively increasing cross-sectional area, whereby the ejector nozzle is provided to bring the air streams to flow along an arcuate air guide surface of the front portion in the outward direction towards the narrowest parts of the air through-flow slit whereby the drive air streams successively mix with air in the ventilating passage upstream of the air guide unit.

7. Device according to claim 1, wherein a separating device is provided in the suction means between the connecting unit for connecting the spray gun and a device for generating a vacuum in the suction means for separating dissolvent sucked from the spray gun from an air/dissolvent-mixture and collecting this dissolvent, whereby the separating device has an opening for discharging collected dissolvent such that it may flow to the collecting container.

8. Device according to claim 7, wherein the separating device comprises a collecting vessel for collecting dissolvent sucked from the spray gun, the collecting vessel includes the connecting means, the collecting vessel is moveable to a position (A) for connection to a device generating a vacuum in the suction means by pressing the spray gun against the collecting vessel, the collecting vessel comprises a drain valve which is kept closed when there is a vacuum in the collecting vessel, the collecting vessel is provided to move from the position (A) connecting to the device generating a vacuum in the suction generating a vacuum in the suction means to a position (N) separated from said vacuum-generating device when the spray gun is removed from the connecting unit, and the drain valve permits dissolvement collected in the collecting vessel to flow to the collecting container through the washing bowl, while the vacuum in the collecting vessel is ceased to exist when said vessel is separated from the device generating a vacuum in the suction means.

9. Device according to claim 1, wherein the interior of a washing bowl at least at the bottom has substantially the shape of an upwards open semisphere, whereby at least the lower spheric parts of the interior of the washing bowl can be cleaned by means of a cleaning tool having a cleaning edge corresponding to the spheric shape.

* * * * *